US006286336B1

(12) United States Patent
Prosser

(10) Patent No.: US 6,286,336 B1
(45) Date of Patent: Sep. 11, 2001

(54) CRYOGENIC AIR SEPARATION SYSTEM FOR ELEVATED PRESSURE PRODUCT

(75) Inventor: Neil Mark Prosser, Lockport, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/563,342

(22) Filed: May 3, 2000

(51) Int. Cl.[7] ..... F25J 3/00

(52) U.S. Cl. ..... 62/648; 62/651; 62/652; 62/653

(58) Field of Search ..... 62/651, 643, 650, 62/648, 652, 653

(56) References Cited

U.S. PATENT DOCUMENTS

| | | | | |
|---|---|---|---|---|
| 4,072,023 | * | 2/1978 | Springmann | 62/650 |
| 4,796,431 | | 1/1989 | Erickson | 62/31 |
| 5,251,451 | * | 10/1993 | Xu et al. | 62/643 |
| 5,263,327 | | 11/1993 | Drnevich et al. | 62/24 |
| 5,341,646 | | 8/1994 | Agrawal et al. | 62/25 |
| 5,475,980 | | 12/1995 | Grenier et al. | 62/24 |
| 5,600,970 | | 2/1997 | Drnevich et al. | 62/651 |
| 5,675,977 | * | 10/1997 | Prosser | 62/646 |
| 5,839,296 | * | 11/1998 | Bonaquist et al. | 62/650 |
| 5,901,576 | | 5/1999 | Agrawal et al. | 62/646 |

* cited by examiner

*Primary Examiner*—William Doerrler
(74) *Attorney, Agent, or Firm*—Stanley Ktorides

(57) ABSTRACT

A cryogenic air separation system particularly useful for producing elevated pressure product wherein additional reflux is generated by a heat pump circuit operating between the upper portion and an intermediate location of the lower pressure column of a double column.

17 Claims, 3 Drawing Sheets

CRYOGENIC AIR SEPARATION SYSTEM FOR ELEVATED PRESSURE PRODUCT

TECHNICAL FIELD

This invention relates generally to cryogenic air separation and is particularly useful for the production of elevated pressure product or products using cryogenic air separation.

BACKGROUND ART

In the practice of cryogenic air separation for the production of nitrogen product and/or oxygen product, it is at times desired to produce such product or products at an elevated pressure. One very effective way for producing elevated pressure product using cryogenic air separation is to operate the column system used to carry out the cryogenic air separation at an elevated pressure. Unfortunately, such operating practice generally results in lower recovery or yield of such elevated pressure product(s).

Accordingly, it is an object of this invention to provide an improved cryogenic air separation system which can be used to effectively produce one or more products at elevated pressure without significantly compromising the recovery of such product(s).

SUMMARY OF THE INVENTION

The above and other objects, which will become apparent to those skilled in the art upon a reading of this disclosure, are attained by the present invention, one aspect of which is:

A method for carrying out cryogenic air separation comprising:

(A) passing feed air into a higher pressure column and separating the feed air by cryogenic rectification within the higher pressure column into nitrogen-enriched fluid and oxygen-enriched fluid;

(B) passing nitrogen-enriched fluid and oxygen-enriched fluid from the higher pressure column into a lower pressure column, and producing by cryogenic rectification within the lower pressure column nitrogen-rich vapor and oxygen-rich fluid;

(C) withdrawing nitrogen-rich vapor from the upper portion of the lower pressure column, compressing the withdrawn nitrogen-rich vapor, condensing the compressed nitrogen-rich vapor by indirect heat exchange with intermediate liquid from the lower pressure column to produce nitrogen-rich liquid, and passing the nitrogen-rich liquid into the upper portion of the lower pressure column; and (D) recovering at least one of nitrogen-rich vapor, oxygen-rich fluid and nitrogen-enriched fluid as product.

Another aspect of the invention is:

Apparatus for carrying out cryogenic air separation comprising:

(A) a higher pressure column, a lower pressure column having an intermediate reboiler, and means for passing feed air into the higher pressure column;

(B) means for passing fluid from the higher pressure column into the lower pressure column;

(C) a compressor, means for passing fluid from the upper portion of the lower pressure column to the compressor, means for passing fluid from the compressor to the intermediate reboiler, and means for passing fluid from the intermediate reboiler to the upper portion of the lower pressure column; and (D) means for recovering product from at least one of the upper portion of the lower pressure column, the lower portion of the lower pressure column, and the upper portion of the higher pressure column.

As used herein, the terms "upper portion" and "lower portion" means those sections of a column respectively above and below the mid point of the column.

As used herein, the term "indirect heat exchange" means the bringing of two fluids into heat exchange relation without any physical contact or intermixing of the fluids with each other.

As used herein, the term "feed air" means a mixture comprising primarily nitrogen and oxygen, such as ambient air.

As used herein, the terms "turboexpansion" and "turboexpander" mean respectively method and apparatus for the flow of high pressure gas through a turbine to reduce the pressure and the temperature of the gas thereby generating refrigeration.

As used herein, the term "column" means a distillation of fractionation column or zone, i.e. a contacting column or zone wherein liquid and vapor phases are countercurrently contacted to effect separation of a fluid mixture, as for example, by contacting or the vapor and liquid phases on a series of vertically spaced trays or plates mounted within the column and/or on packing elements which may be structured packing and/or random packing elements. For a further discussion of distillation columns see the Chemical Engineers' Handbook, Fifth Edition, edited by R. H. Perry and C. H. Chilton, McGraw-Hill Book Company, New York, Section 13, "Distillation" B. D. Smith et al., page 13–3, The Continuous Distillation Process. The term, double column is used to mean a higher pressure column having its upper end in heat exchange relation with the lower end of a lower pressure column. A further discussion of double columns appears in Ruheman "The Separation of Gases" Oxford University Press, 1949, Chapter VII, Commercial Air Separation.

Vapor and liquid contacting separation processes depend on the difference in vapor pressures. Distillation is the separation process whereby heating of a liquid mixture can be used to concentrate the volatile component(s) in the vapor phase and the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and includes integral or differential contact between the phases. Separation process arrangements that utilize the principles of rectification to separate mixtures are often interchangeably termed rectification columns, distillation columns, or fractionation columns. Cryogenic rectification is a rectification process carried out, at least in part, at temperatures at or below 150 degrees Kelvin.

As used herein, the term "tray" means a contacting stage, which is not necessarily an equilibrium stage, and may mean other contacting apparatus such as packing having a separation capability equivalent to one tray.

As used herein, the term "equilibrium stage" means a vapor-liquid contacting stage whereby the vapor and liquid leaving the stage are in mass transfer equilibrium, e.g. a tray having 100 percent efficiency or a packing element height equivalent to one theoretical plate (HETP).

As used herein, the term "top" when referring to a column means that section of the column above the column mass transfer internals, i.e. trays or packing.

As used herein, the term "bottom" when referring to a column means that section of the column below the column mass transfer internals, i.e. trays or packing.

As used herein, the term "intermediate" when referring to a column means that section of the column above the bottom and below the top.

As used herein, the term "intermediate liquid" means liquid from the intermediate section of a column.

As used herein, the term "intermediate reboiler" means a heat exchanger wherein intermediate liquid of a column is vaporized for upflow within the column. An intermediate reboiler may be physically within or outside of the column.

As used herein, the term "cold compression" means the method of mechanically raising the pressure of a gas stream that is lower in temperature than the ambient level feeds to the cryogenic separation system. The mechanical energy of cold compression must be balanced by refrigeration.

DETAILED DESCRIPTION

The invention, in general, comprises the generation of additional reflux to overcome reduced recovery in the operation of a double column system at elevated pressure, by the operation of a heat pump circuit operating between the top and an intermediate portion of the lower pressure column of the double column. Preferably the compression of the heat pump circuit is cold compression and is powered, at least in part, by turboexpansion of a process stream such as higher pressure column shelf vapor or lower pressure column top vapor. The invention will be described in greater detail with reference to the Drawings.

Figure 1:
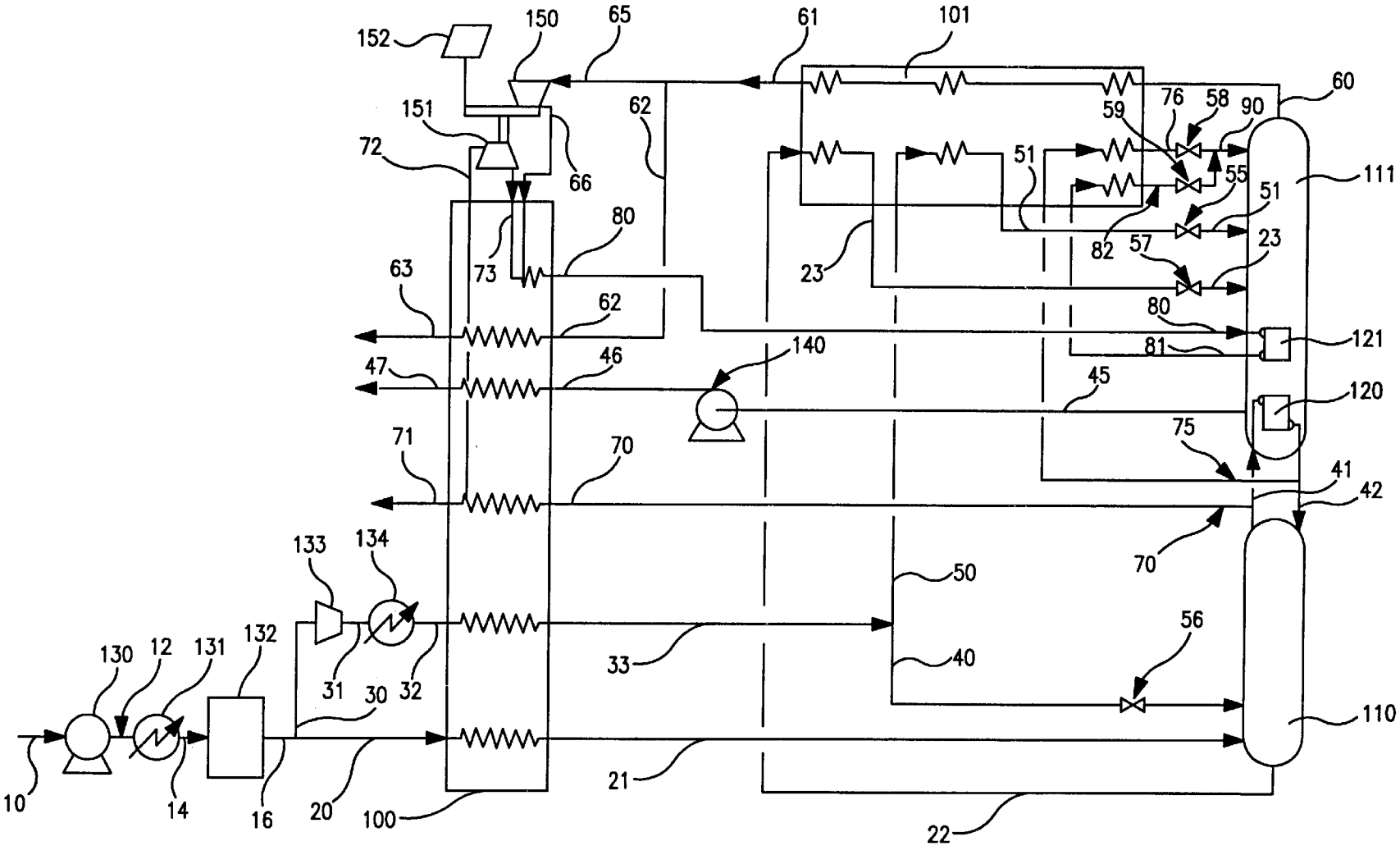
FIG. 1 is a schematic representation of one preferred embodiment of the invention wherein higher pressure column shelf vapor is turboexpanded to power the compression of the heat pump circuit.

Referring now to FIG. 1, feed air 10 is compressed by passage through compressor 130 to a pressure generally within the range of from 70 to 305 pounds per square inch absolute (psia). Resulting compressed feed air 12 is cooled of the heat of compression by passage through cooler 131 and then passed in stream 14 to purifier 132 wherein it is cleaned of high boiling impurities such as carbon dioxide, water vapor and hydrocarbons to form cleaned feed air 16 for passage into the column system. In the embodiment of the invention illustrated in FIG. 1, a portion of the feed air is passed to the column system as liquid. In this embodiment, a portion 30, comprising from 23 to 35 percent of the total feed air 16, is further compressed by passage through booster compressor 133 and resulting further compressed feed air portion 31 is cooled of the heat of compression in cooler 134. Resulting feed air portion in stream 32 is condensed by passage through primary heat exchanger 100 to form liquefied feed air stream 33. Stream 33 is divided into liquid air portions 50 and 40. Liquid air portion in stream 50 is subcooled by passage through subcooler 101 and subcooled liquid air stream 51 is passed through valve 55 and into lower pressure column 111. Liquefied feed air stream 40 is passed through valve 56 and into higher pressure column 110. Another portion 20 of cleaned feed air stream 16 is cooled by passage through primary heat exchanger 100 by indirect heat exchange with return streams, and resulting cooled feed air stream 21 is passed into higher pressure column 110.

Higher pressure cryogenic rectification column 110, which is the higher pressure column of a double column system which also includes lower pressure cryogenic rectification column 111, is operating at a pressure generally within the range of from 65 to 300 psia. Within higher pressure column 110 the feed air is separated by cryogenic rectification into nitrogen-enriched fluid and oxygen-enriched fluid. Oxygen-enriched fluid is withdrawn from the lower portion of column 110 in liquid stream 22, subcooled by passage through subcooler 101 to form subcooled oxygen-enriched liquid stream 23 and then passed through valve 57 into lower pressure column 111. Nitrogen-enriched fluid is withdrawn from the upper portion of column 110 in vapor stream 41 and passed into lower pressure column bottom condenser 120 wherein it is condensed by indirect heat exchange with lower pressure column bottom liquid. Resulting condensed nitrogen-enriched fluid 42 is passed back into higher pressure column 110 as reflux. A portion 75 of the condensed nitrogen-enriched fluid may be withdrawn and subcooled by passage through subcooler 101 to form subcooled nitrogen-enriched liquid stream 76 which is passed through valve 58 and into the upper portion of lower pressure column 111 as reflux. A portion of the nitrogen-enriched fluid from the upper portion of column 110, shown in the embodiment illustrated in FIG. 1 as stream 70, may be recovered as product nitrogen having an oxygen impurity concentration of no more than 2 mole percent. In the embodiment illustrated in FIG. 1 a portion 71 of stream 70 is so recovered after passage through primary heat exchanger 100, and another portion 72 is turboexpanded as will be more fully described below.

Lower pressure column 111 is operating at a pressure less than that of higher pressure column 110 and generally within the range of from 16 to 130 psia. Within lower pressure column 111 the various feeds into that column are separated by cryogenic rectification into nitrogen-rich vapor and oxygen-rich fluid. Oxygen-rich fluid is withdrawn and recovered from the lower portion of column 111 as oxygen product having an oxygen concentration generally within the range of from 85 to 98 mole percent. In the embodiment of the invention illustrated in FIG. 1, the oxygen-rich fluid is withdrawn from the lower portion of column 111 as liquid stream 45 and pumped to a higher pressure by passage through liquid pump 140 to form stream 46. The liquid in stream 46 is vaporized by passage through primary heat exchanger 100 to form high pressure oxygen product gas for recovery in stream 47.

Nitrogen-rich vapor is withdrawn from the upper portion, preferably the top, of lower pressure column 111 in stream 60 and warmed by passage through heat exchanger 101 to form nitrogen-rich vapor stream 61. A portion 62 of stream 61 is further warmed by passage through primary heat exchanger 100 and may be recovered as nitrogen product in stream 63 having an oxygen impurity concentration of no more than 2 mole percent. Another portion 65 of stream 61, generally comprising from 5 to 20 percent of stream 61, is compressed by passage through compressor 150 to form compressed nitrogen-rich vapor stream 66. Preferably, as illustrated in FIG. 1, the compression of stream 65 is cold compression although at least some of the compression could be warm compression, i.e. compression after the nitrogen-rich vapor traverses heat exchanger 100. Compressed nitrogen-rich vapor stream 66 is preferably cooled by partial traverse of primary heat exchanger 100 and resulting nitrogen-rich vapor in stream 80 is passed to intermediate reboiler 121. Within intermediate reboiler 121 the nitrogen-rich vapor is condensed by indirect heat exchange with intermediate liquid from column 111. Generally the intermediate liquid will be from 0 to 10 equilibrium stages below the feed stage of stream 23. The resulting nitrogen-rich liquid is withdrawn from intermediate reboiler 121 in stream 81, subcooled by passage through subcooler 101 to form stream 82 and then passed through valve 59 and into the upper portion of column 111 as additional reflux. In the embodiment illustrated in FIG. 1 stream 82 is combined with stream 76 to form stream 90 for passage into column 111.

Compressor 150 may be driven by an external energy source. Preferably some or all of the power to drive compressor 150 is from the operation of a turboexpander such as turboexpander 151 which, in the embodiment illustrated in FIG. 1, is mechanically coupled to compressor 150. In the embodiment illustrated in FIG. 1, turboexpander 151 is driven by the turboexpansion of nitrogen-enriched vapor stream 72 which is taken from stream 70 after partial traverse of primary heat exchanger 100. Resulting turboexpanded nitrogen-enriched vapor 73 is then condensed by heat exchange with lower pressure column intermediate liquid to form still more additional reflux for passage into the upper portion of column 111. In a particularly preferred embodiment illustrated in FIG. 1, stream 73 is combined with stream 66 to form combined stream 80 for processing in intermediate reboiler 121 as was previously described. Thus this nitrogen-enriched fluid becomes part of the heat pump circuit. Turboexpander 151 must extract enough energy from the system to balance the energy required by the cold compressor, as well as the other refrigeration loads on the system, such as liquid products and ambient heat. Thus, energy must be extracted from the system in addition to that absorbed by cold compressor 150. Generator 152 provides an efficient means of absorbing the energy removed from the system.

Figure 2:
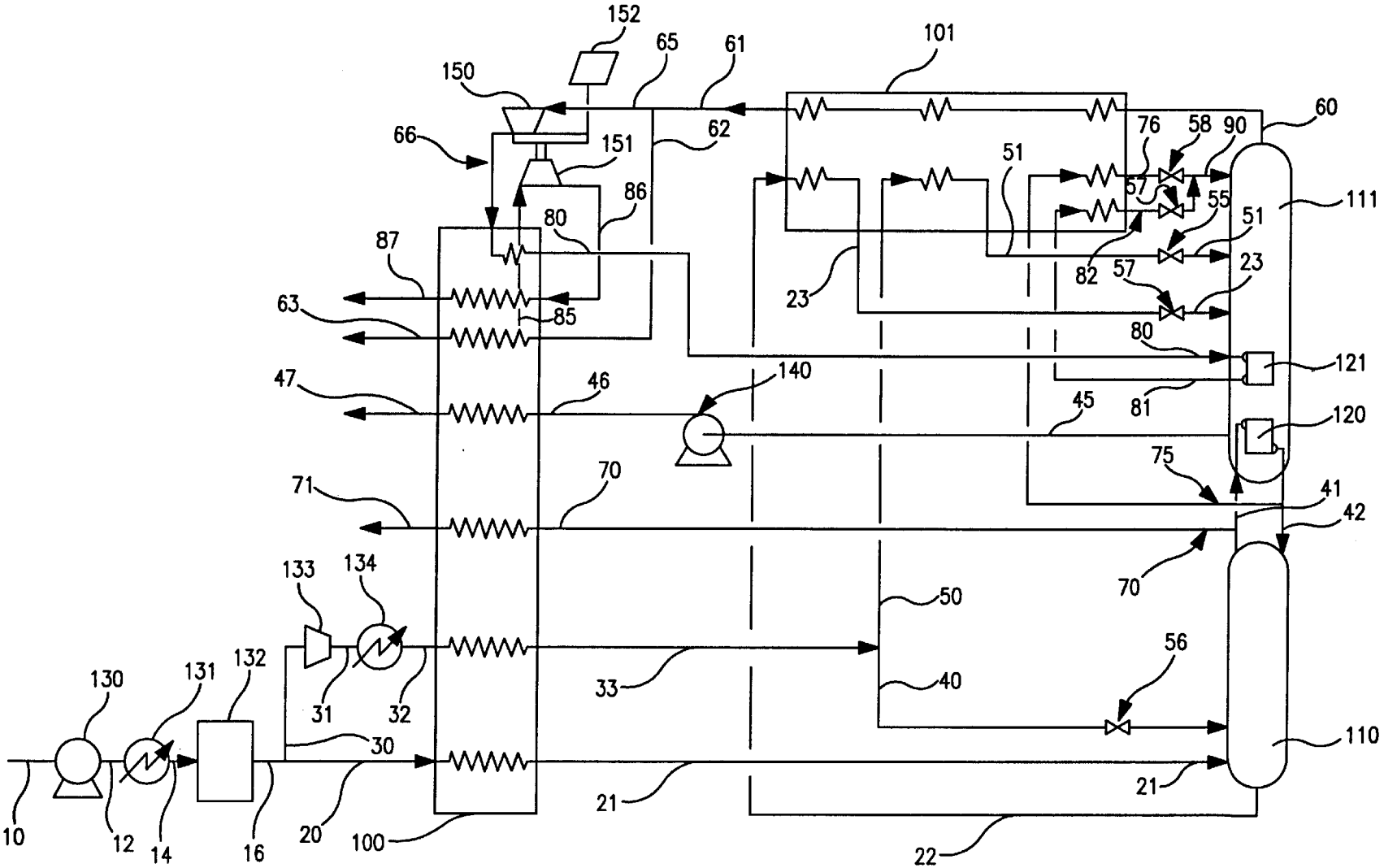
FIG. 2 is a schematic representation of another preferred embodiment of the invention wherein lower pressure column top vapor is turboexpanded to power the compression of the heat pump circuit.

FIG. 2 illustrates another embodiment of the invention wherein turboexpander 151 is driven by nitrogen-rich vapor. The numerals in FIG. 2 correspond to those of FIG. 1 for the common elements, and these common elements will not be described again in detail. In the practice of the invention in accord with the embodiment illustrated in FIG. 2, if it is desired to recover some nitrogen-enriched vapor as product nitrogen, as shown in FIG. 2, all of stream 70 may be passed through primary heat exchanger 100 for recovery in stream 71.

Referring now to FIG. 2, a portion 85 of nitrogen-rich vapor stream 62 is passed, after partial traverse of primary heat exchanger 100, to turboexpander 151 wherein it is turboexpanded to generate refrigeration and form turboexpanded refrigeration bearing stream 86. Stream 86 is then warmed by passage through primary heat exchanger 100 and is removed from the system in stream 87 which may be recovered in whole or in part as lower pressure nitrogen product.

Figure 3:
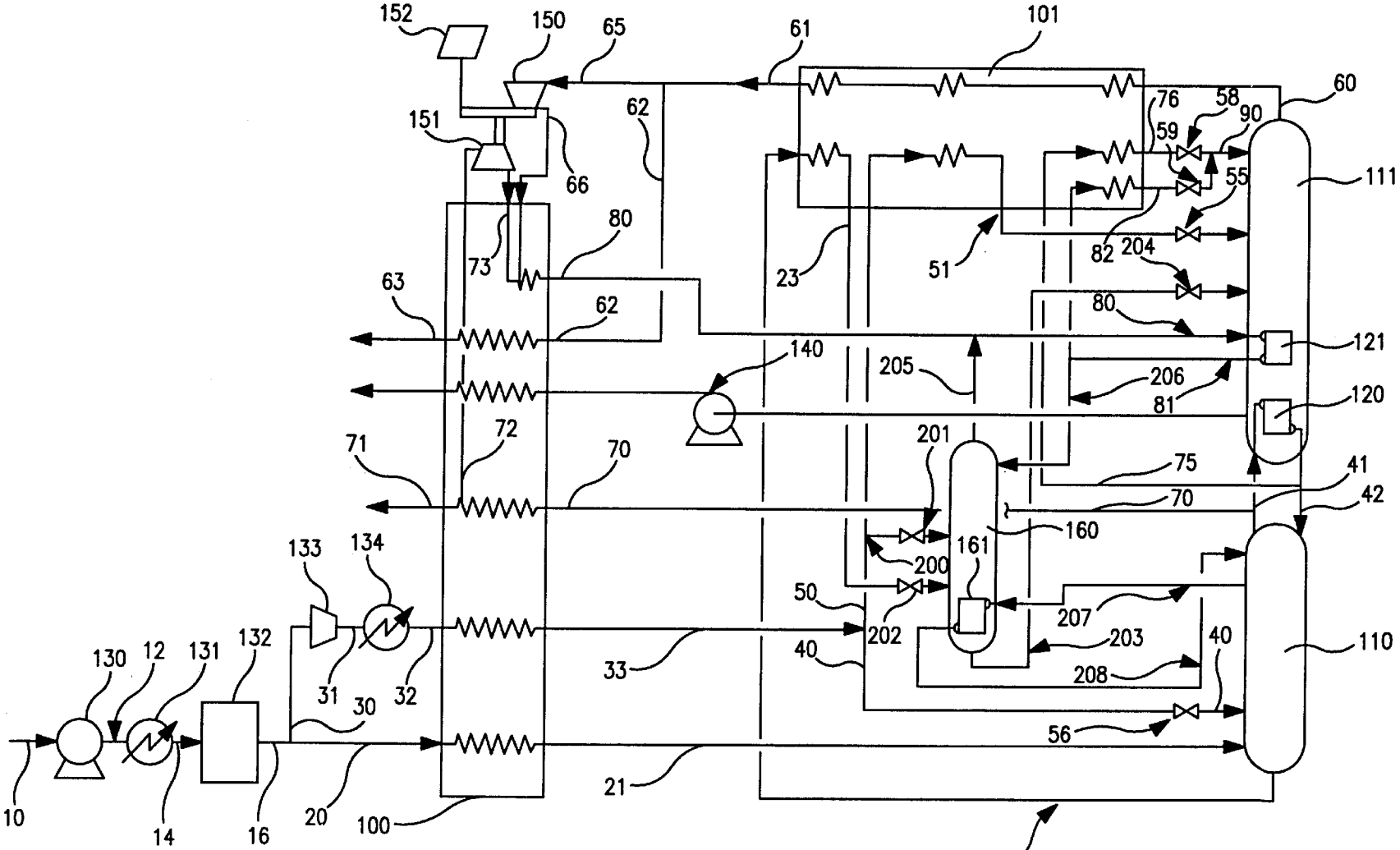
FIG. 3 is a schematic representation of another preferred embodiment of the invention wherein a kettle liquid column is employed in conjunction with the double column.

FIG. 3 illustrates another embodiment of the invention wherein a third column is used in addition to the double column. The numerals in FIG. 3 correspond to those of FIG. 1 for the common elements, and these common elements will not be described again in detail. The arrangement illustrated in FIG. 3 is very power efficient and capable of operating at very high pressure levels.

Referring now to FIG. 3, a portion 200 of liquid air stream 50 may be passed through valve 201 and into third or kettle liquid column 160. Subcooled oxygen-enriched liquid stream 23 is passed through valve 202 and into kettle liquid column 160 wherein the feeds are separated by cryogenic rectification into nitrogen-containing top vapor and oxygen-containing bottom liquid. The oxygen-containing bottom liquid is passed in stream 203 from the lower portion of third column 160 through valve 204 and into lower pressure column 111 for subsequent separation therein in accord with the previous description. Nitrogen-containing top vapor is withdrawn from the upper portion of third column 160 in stream 205 and combined with stream 80 for passage into intermediate reboiler 121. A portion of condensed stream 81 from intermediate reboiler 121 is passed into the upper portion of third column 160 as reflux. Kettle liquid column 160 is driven by the operation of bottom reboiler 161. Nitrogen-enriched fluid taken from several stages below the top of column 110 is passed in stream 207 to bottom reboiler 161 wherein it is condensed by indirect heat exchange with boiling oxygen-containing liquid. The resulting condensed nitrogen-enriched liquid is returned to column 110 in stream 208 at a level above the level from which stream 207 is withdrawn.

Although the invention has been described in detail with reference to certain preferred embodiments, those skilled in the art will recognize that there are other embodiments of the invention within the spirit and the scope of the claims. For example, a portion of the feed air may be turboexpanded to power the compression of the heat pump circuit and then passed into the lower pressure column, preferably after condensation by indirect heat exchange with intermediate liquid.

What is claimed is:

1. A method for carrying out cryogenic air separation comprising:

(A) passing feed air into a higher pressure column and separating the feed air by cryogenic rectification within the higher pressure column into nitrogen-enriched fluid and oxygen-enriched fluid;

(B) passing nitrogen-enriched fluid and oxygen-enriched fluid from the higher pressure column into a lower pressure column, and producing by cryogenic rectification within the lower pressure column nitrogen-rich vapor and oxygen-rich fluid;

(C) withdrawing nitrogen-rich vapor from the upper portion of the lower pressure column, compressing the withdrawn nitrogen-rich vapor wherein at least some of said compression is cold compression, condensing the compressed nitrogen-rich vapor by indirect heat exchange with intermediate liquid from the lower pressure column to produce nitrogen-rich liquid, and passing the nitrogen-rich liquid into the upper portion of the lower pressure column; and (D) recovering at least one of nitrogen-rich vapor, oxygen-rich fluid and nitrogen-enriched fluid as product.

2. The method of claim 1 further comprising turboexpanding a portion of the nitrogen-enriched fluid, condensing the turboexpanded nitrogen-enriched fluid by indirect heat exchange with intermediate liquid from the lower pressure column to produce nitrogen-enriched liquid, and passing said nitrogen-enriched liquid into the upper portion of the lower pressure column.

3. The method of claim 2 wherein the turboexpanded nitrogen-enriched fluid is combined with the compressed nitrogen-rich vapor prior to the heat exchange with the intermediate liquid.

4. A method for carrying out cryogenic air separation comprising:

(A) passing feed air into a higher pressure column and separating the feed air by cryogenic rectification within the higher pressure column into nitrogen-enriched fluid and oxygen-enriched fluid;

(B) passing nitrogen-enriched fluid from the higher pressure column into a lower pressure column, passing oxygen-enriched fluid from the higher pressure column into a third column, producing by cryogenic rectification within the third column nitrogen-containing top vapor and oxygen-containing bottom liquid, passing oxygen-containing bottom liquid from the third column into the lower pressure column, and producing by cryogenic rectification within the lower pressure column nitrogen-rich vapor and oxygen-rich liquid;

(C) withdrawing nitrogen-rich vapor from the upper portion of the lower pressure column, compressing the withdrawn nitrogen-rich vapor wherein at least some of said compression is cold compression, condensing the compressed nitrogen-rich vapor by indirect heat exchange with intermediate liquid from the lower pressure column to produce nitrogen-rich liquid, and passing the nitrogen-rich liquid into the upper portion of the lower pressure column; and (D) recovering at least one of nitrogen-rich vapor, oxygen-rich fluid and nitrogen-enriched fluid as product.

5. The method of claim 4 further comprising condensing nitrogen-containing top vapor by indirect heat exchange with intermediate liquid from the lower pressure column to produce nitrogen-containing liquid, and passing nitrogen-containing liquid into the upper portion of at least one of the lower pressure column and the third column.

6. Apparatus for carrying out cryogenic air separation comprising:

(A) a primary heat exchanger, a higher pressure column, a lower pressure column having an intermediate reboiler, and means for passing feed air to the primary heat exchanger and from the primary heat exchanger into the higher pressure column;

(B) means for passing fluid from the higher pressure column into the lower pressure column;

(C) a compressor, means for passing fluid from the upper portion of the lower pressure column to the compressor without passing through the primary heat exchanger, means for passing fluid from the compressor to the intermediate reboiler, and means for passing fluid from the intermediate reboiler to the upper portion of the lower pressure column; and (D) means for recovering product from at least one of the upper portion of the lower pressure column, the lower portion of the lower pressure column, and the upper portion of the higher pressure column.

7. The apparatus of claim 6 further comprising a turboexpander, means for passing fluid from the upper portion of the higher pressure column to the turboexpander and means for passing fluid from the turboexpander to the intermediate reboiler.

8. The apparatus of claim 6 further comprising a turboexpander and means for passing fluid from the upper portion of the lower pressure column to the turboexpander.

9. The apparatus of claim 6 further comprising a third column, means for passing fluid from the lower portion of the higher pressure column into the third column, and means for passing fluid from the lower portion of the third column into the lower pressure column.

10. The apparatus of claim 9 further comprising means for passing fluid from the upper portion of the third column to the intermediate reboiler.

11. The method of claim 1 wherein all of the said compression of the withdrawn nitrogen-rich vapor is cold compression.

12. The method of claim 2 wherein the turboexpansion of the nitrogen-enriched fluid provides power to carry out the said compression of the withdrawn nitrogen-rich vapor.

13. The method of claim 4 wherein all of the said compression of the withdrawn nitrogen-rich vapor is cold compression.

14. The method of claim 4 further comprising turboexpanding a portion of the nitrogen-enriched fluid, condensing the turboexpanded nitrogen-enriched fluid by indirect heat exchange with intermediate liquid from the lower pressure column to produce nitrogen-enriched liquid, and passing said nitrogen-enriched liquid into the upper portion of the lower pressure column.

15. The method of claim 14 wherein the turboexpansion of the nitrogen-enriched fluid provides power to carry out the said compression of the withdrawn nitrogen-rich vapor.

16. The apparatus of claim 7 wherein the said turboexpander is mechanically coupled to said compressor.

17. The apparatus of claim 8 wherein the said turboexpander is mechanically coupled to said compressor.

* * * * *